US005697820A

United States Patent [19]

Saito et al.

[11] Patent Number: 5,697,820

[45] Date of Patent: Dec. 16, 1997

[54] OUTBOARD MARINE PROPULSION SYSTEM

[75] Inventors: Chitoshi Saito; Yasunari Okamoto, both of Hamamatsu, Japan

[73] Assignee: Sanshin Kogyo Kabushiki Kaisha, Hamamatsu, Japan

[21] Appl. No.: 609,174

[22] Filed: Mar. 1, 1996

[30] Foreign Application Priority Data

Mar. 3, 1995 [JP] Japan ..... 7-043974

[51] Int. Cl.[6] ..... B63H 5/125

[52] U.S. Cl. ..... 440/57; 440/79; 440/900

[58] Field of Search ..... 440/49, 53, 55–63, 440/75, 78, 82, 83, 900

[56] References Cited

U.S. PATENT DOCUMENTS 2,096,457 10/1937 Irgens ..... 440/75

4,549,869 10/1985 Iida et al. ..... 440/53

*Primary Examiner*—Jesus D. Sotelo

*Attorney, Agent, or Firm*—Knobbe, Martens, Olson & Bear LLP

[57] ABSTRACT

A number of embodiments of outboard drive systems that include a combined vertically extending drive shaft driven by the propulsion unit and which drives a generally horizontally extending drive shaft that drives a propulsion device positioned substantially rearwardly of the transom. The propulsion system is supported for steering and trim movement about respective spaced apart axes and these axes are both disposed substantially below the transom of the associated watercraft.

15 Claims, 6 Drawing Sheets

OUTBOARD MARINE PROPULSION SYSTEM

BACKGROUND OF THE INVENTION

This invention relates to an outboard marine propulsion system and more particularly to the type of outboard propulsion system wherein the propulsion device is disposed substantially to the rear of the transom or hull of the associated watercraft.

A familiar type of outboard motor is adapted to be mounted on the transom of a watercraft and is pivotal about a generally vertically extending axis for steering and about a generally horizontally extending axis that is transverse to the steering axis for tilt and trim movement. With this more conventional type of outboard motor, the engine is mounted in the power head so that its output shaft rotates about a vertically extending axis. The output shaft is, in turn, connected in a lower unit and drive shaft housing assembly to a propulsion device that is disposed substantially vertically beneath the power head for propulsion of the watercraft. As a result, the propulsion device is positioned quite close to the transom or hull of the watercraft.

With another type of outboard motor, the propulsion device is driven primarily by a longitudinally extending drive shaft which is connected at its forward end to the engine output shaft. The engine is thus disposed with its output shaft extending at an acute angle to the horizontal. A propulsion device is carried at the rear end of the elongated drive shaft for propelling the watercraft. This type of outboard motor is also supported for steering movement about a vertical axis and for movement about a horizontal axis. The horizontal axis movement is not necessarily limited to tilt and trim movement, but may be employed so that the propeller or propulsion device can be easily lifted out of the body of water to clear underwater objects and for other reasons.

However, with this type of device the horizontal axis is disposed substantially at the upper portion of the transom and, hence, the elongated propeller shaft extends through a rather steep angle. Thus, the range of movement of the generally horizontally extending drive shaft is somewhat limited. In addition, the overall construction can intrude significantly into the hull of the watercraft. Also the mounting of the engine does not permit the use of conventional engines as used in the more conventional type of outboard motors.

It is, therefore, a principal object of this invention to provide an improved outboard propulsion device wherein the propulsion device is freely movable about a horizontal axis, but wherein this axis is disposed relatively low in relation to the transom of the watercraft.

It is a further object of this invention to provide an outboard propulsion system of this type that embodies a longitudinally extending drive shaft portion which drives at its rearward end a propulsion device and wherein this longitudinally extending shaft is disposed at a relatively shallow angle to the horizontal under most operating conditions.

It is a further object of this invention to provide an outboard propulsion unit of this type that permits the use of a conventional, vertical axis outboard motor engine.

SUMMARY OF THE INVENTION

This invention is adapted to be embodied in an outboard propulsion system that is adapted to be affixed to the rear of a watercraft for propelling the watercraft. The propulsion system comprises a first assembly consisting of a powering internal combustion engine, a generally vertically extending drive shaft housing journaling a first drive shaft driven by the engine and rotatable about a generally vertically extending axis. A second drive shaft housing is affixed at its forward end to the lower end of the first drive shaft housing and extends generally horizontally rearwardly therefrom. A second drive shaft is journaled in the second drive shaft housing. A transmission is provided for driving the second drive shaft from the first drive shaft. A propulsion device is driven by the rear end of the second drive shaft. Means support the outboard propulsion system for steering and tilting movement about respective vertically and horizontally extending transverse axes.

DETAILED DESCRIPTION OF THE PREFERRED EMBODIMENT

Figure 1:
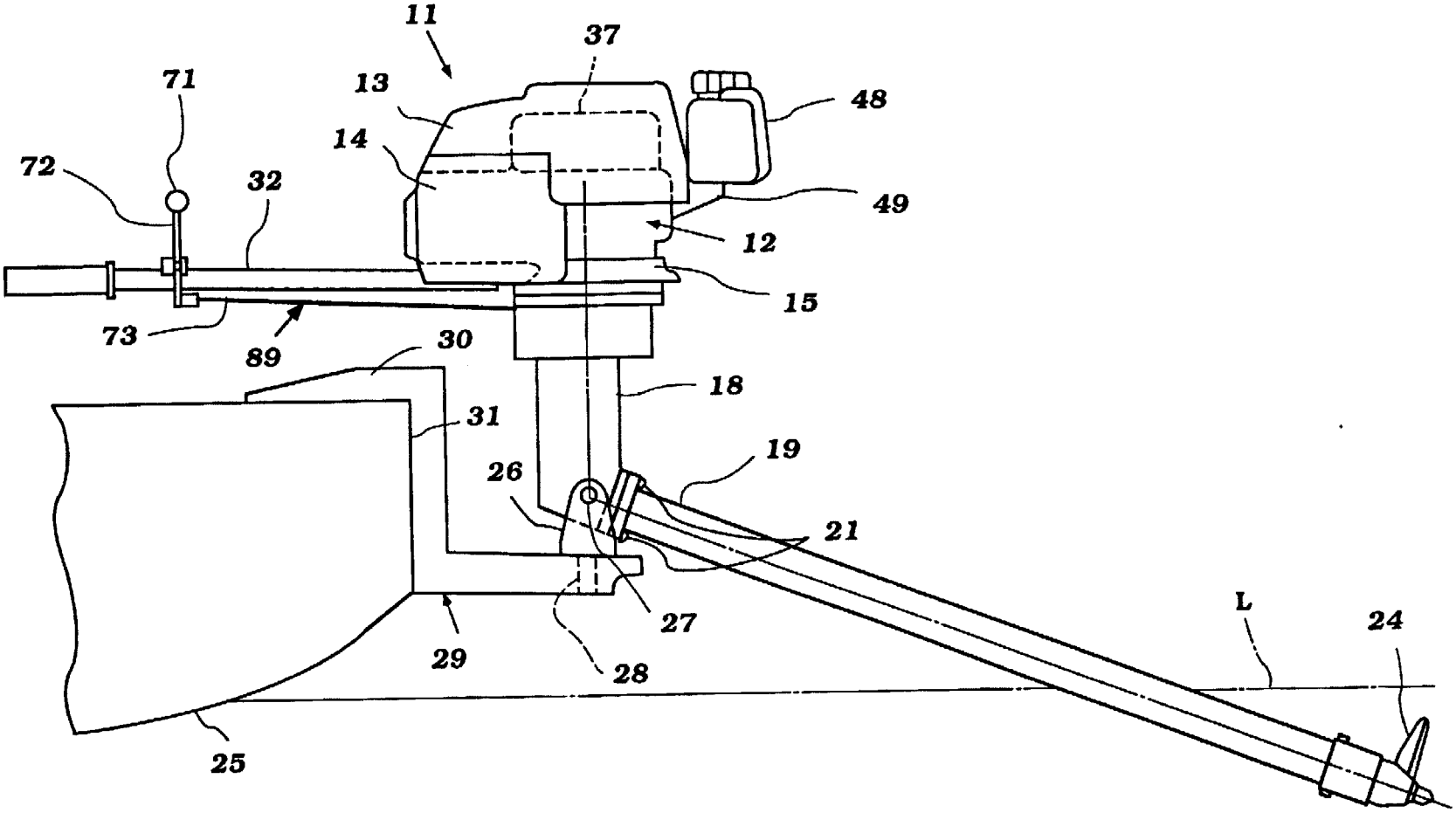
FIG. 1 is a side elevational view of an outboard motor constructed in accordance with an embodiment of the invention mounted to a watercraft.
Figure 2:
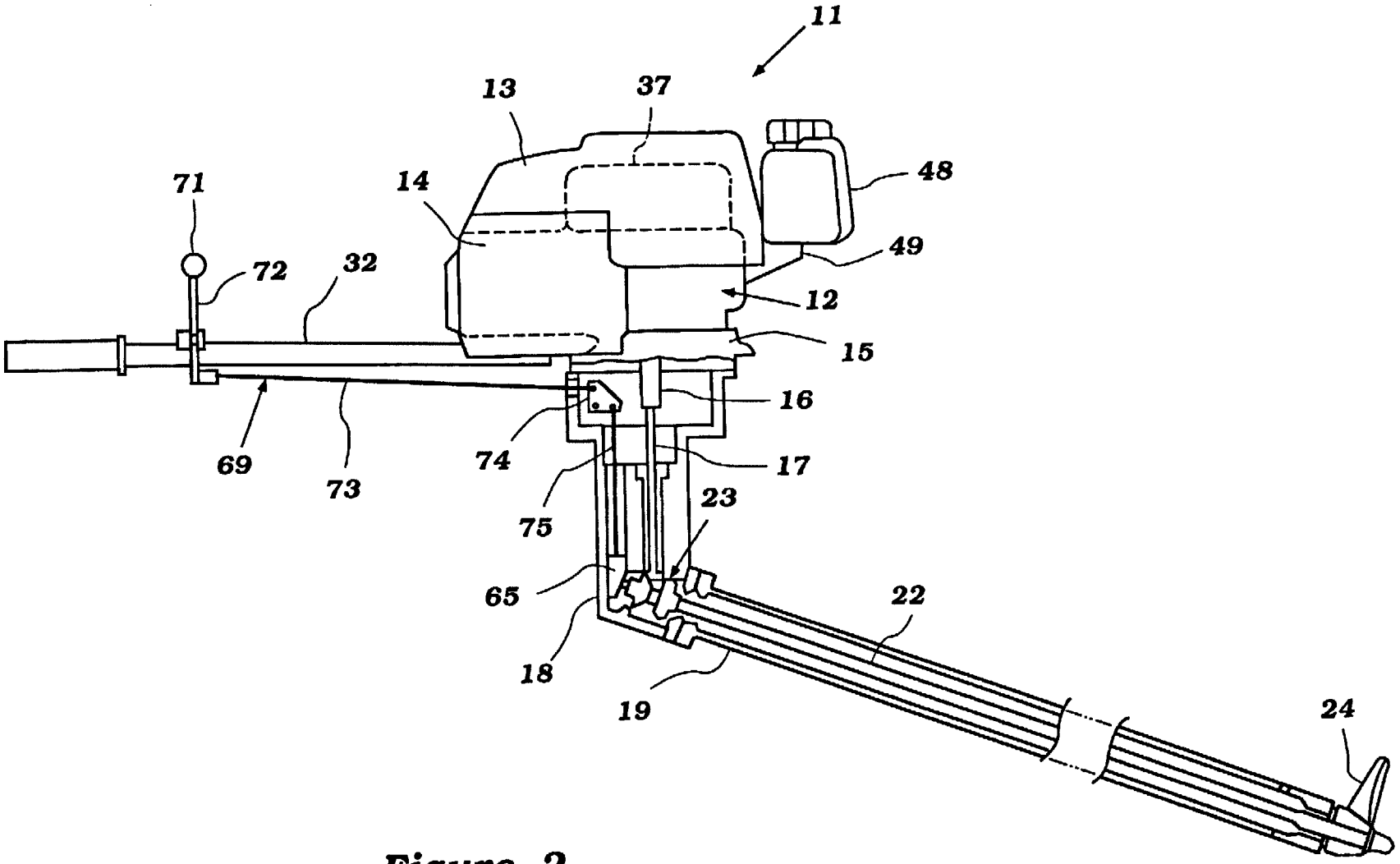
FIG. 2 is a side elevational view of this embodiment with portions of the exterior surfaces removed to show the internal components of the drive assembly.

Referring now to the drawings and initially to FIGS. 1 and 2, an outboard motor is identified generally by the reference numeral 11. The outboard motor 11 is comprised of a power head that consists of a powering internal combustion engine indicated generally by the reference numeral 12 and the surrounding protective cowling comprised of an upper cowling portion 13 that is detachably connected to the top of a main cowling portion 14 that is, in turn, detachably connected along its lower end to a tray portion 15.

As is typical with conventional type outboard motor practice, the engine 12 is supported within the power head so that its output shaft, a crankshaft that is indicated by the reference numeral 16, rotates about a generally vertically extending axis. This output shaft, or crankshaft 16, is rotatably coupled to a first drive shaft that is indicated by the reference numeral 17 and is journaled within a first vertically extending drive shaft housing 18 whose upper portion is encircled by the tray 15.

A second drive shaft housing is indicated by the reference numeral 19 and is affixed to the lower end of the first drive shaft housing 18 by means of bolts 21. The second drive shaft housing 19 extends generally downwardly and rearwardly at an obtuse angle to the first drive shaft housing and journals a second drive shaft that is indicated by the reference numeral 22. At its upper end, the second drive shaft 22 is connected to the first drive shaft 17 through a transmission that is indicated in later FIGS. (2 and 4) by the reference numeral 23 and will be described in detail later by reference to those figures.

At its rearward end, the second drive shaft 22 drives a propulsion device, namely, a propeller 24 through a suitable coupling for driving a watercraft 25 associated with the outboard motor 11 through a body of water.

A bracket 26 is rotatably journaled about a horizontally extending axis at its rearward end by means of a pivot shaft 27 to the lower portion of the first drive shaft housing 18.

The bracket 26 is rotatably journaled about a generally vertically extending axis at its forward end by means of a further pivot shaft 28 to the rear of a mounting bracket that is indicated by the reference numeral 29.

The mounting bracket 29 has a horizontal leg 30 that extends across the rear or transom 31 of the watercraft 25. A vertical drop leg of the bracket 29 is affixed by any suitable means to the rear or transom 31 of the watercraft 25. The pivot shaft 28 is journalled on a lower leg of the bracket 29 which is close to the water level.

Thus, with the above connection, the outboard motor 11 may be rotated about a tilt axis defined by the first pivot shaft 27 and about a steering axis defined by the second pivot shaft 28. This rotation is controlled by an operator control tiller that is indicated by the reference numeral 32 and affixed by any suitable means to the lower surface of the main cowling 14.

Figure 3:
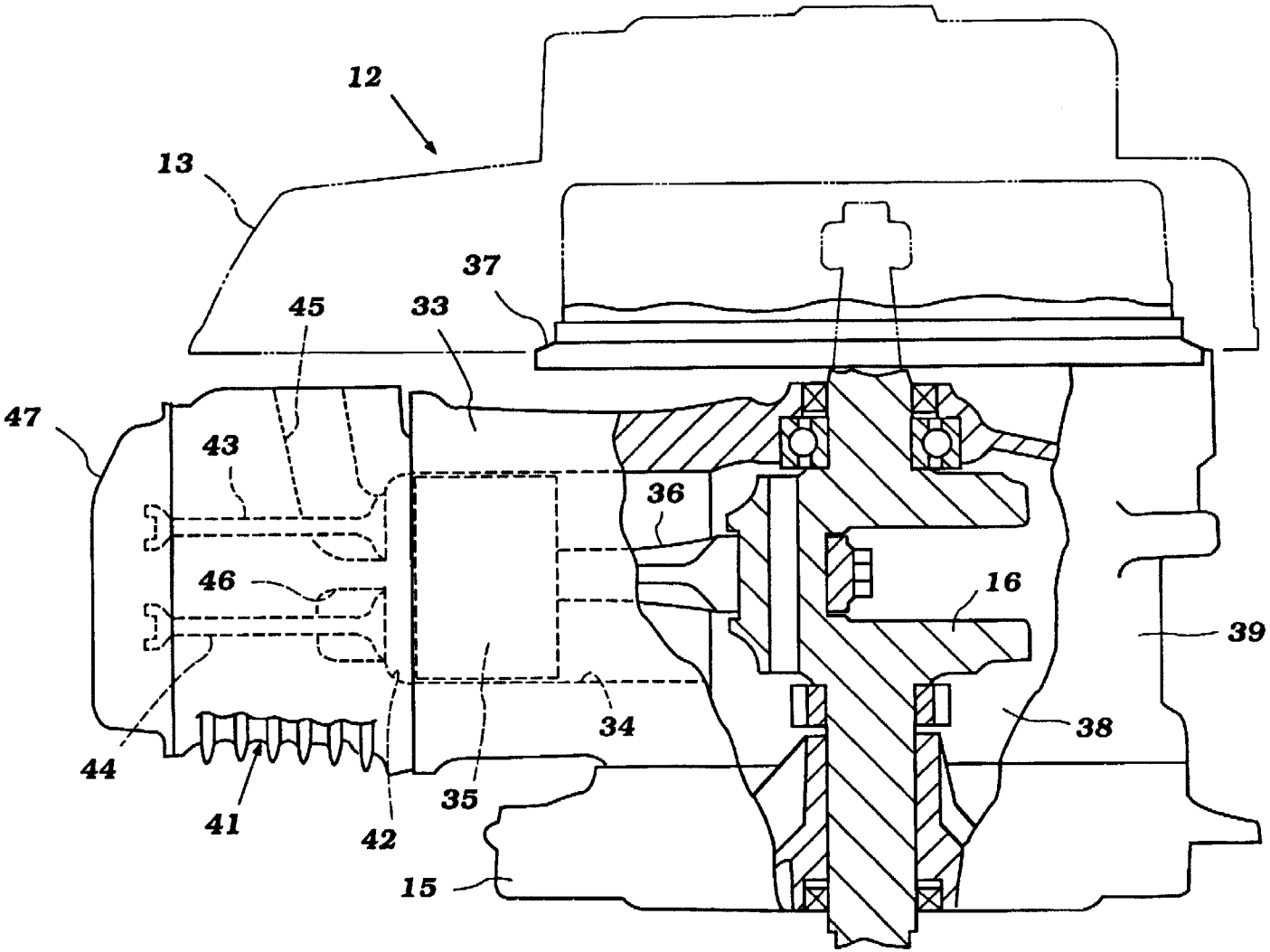
FIG. 3 is an enlarged side elevational view of the powering internal combustion engine with a portions broken away and other portions shown in cross section and certain components shown in phantom.

The internal combustion engine 12 will now be described in detail with reference to FIG. 3. The engine 12 is of a four-stroke type configuration and with a single cylinder, though it should be apparent to those skilled in the art that multicylinder engines of various cylinder arrangements may be utilized in conjunction with the invention and that engines of two-stroke configuration may also be employed. The engine 12 is provided with a cylinder block 33 in which a single horizontally extending cylinder bore 34 is formed. A piston that is indicated by the reference numeral 35 reciprocates within the cylinder bore 34 and is connected to a connecting rod 36 by means of a piston pin (not shown). The lower or big end of the connecting rod 36 is journaled on the throw of the crankshaft 16. At the upper end of the crankshaft 16 there is affixed a flywheel 37. The crankshaft 16 is rotatably journaled about a generally vertical axis within a crankcase chamber 38 formed at the lower end of the cylinder bore 34. The crankcase chamber 38 is formed by the skirt of the cylinder block 33 and a crankcase member 39 that is affixed to the cylinder block 33 in any well known manner.

The end of the cylinder bore 34 opposite the crankcase chamber 38 is closed by means of a cylinder head assembly 41 that is affixed to the cylinder block 33 in any known manner. The cylinder head 41 has recess 42 which cooperates with the cylinder bore 34 and the head of the piston 35 to form a combustion chamber above which is positioned a spark plug (not shown) that has its gap extending into the combustion chamber 42. This combustion chamber has a volume which varies cyclicly during the reciprocation of the piston 35 as is well known in this art.

Intake and exhaust valves are indicated by the reference numerals 43 and 44, respectively, and are disposed within the cylinder head 41 above the recess 42 and control intake and exhaust ports 45 and 46 which are formed in the cylinder head 41 and opened to the combustion chamber 42. The intake and exhaust valves 43 and 44 are operated in any known manner by a valve operating mechanism (not shown) located at least in part underneath a valve cover 47 that encloses the upper surface of the cylinder head 16.

An air fuel charge is delivered to the engine's combustion chamber 42 for compression and ignition therein by means of an air fuel charging system (not shown) that is disposed within the protective cowlings 13 and 14 of the power head and which draws air from the atmosphere through an inlet (not shown) of the upper cowling 13. Fuel is supplied to the air fuel charging system from a fuel tank 48 that is mounted to the rear external surface of the power head by a bracket 49.

When the spark plug fires, the charge in the combustion chamber will ignite, burn and expand. This expanding charge drives the piston 35 downwardly to rotate the crankshaft 16 which, in turn, rotates the first drive shaft 17. The second drive shaft 22 is then driven by the first drive shaft 17 through the transmission 23 which causes the propeller 24 to rotate and, thus, drive the watercraft 25. The burnt charge is discharged through the exhaust port 46 and an appropriate exhaust system (not shown).

Figure 4:
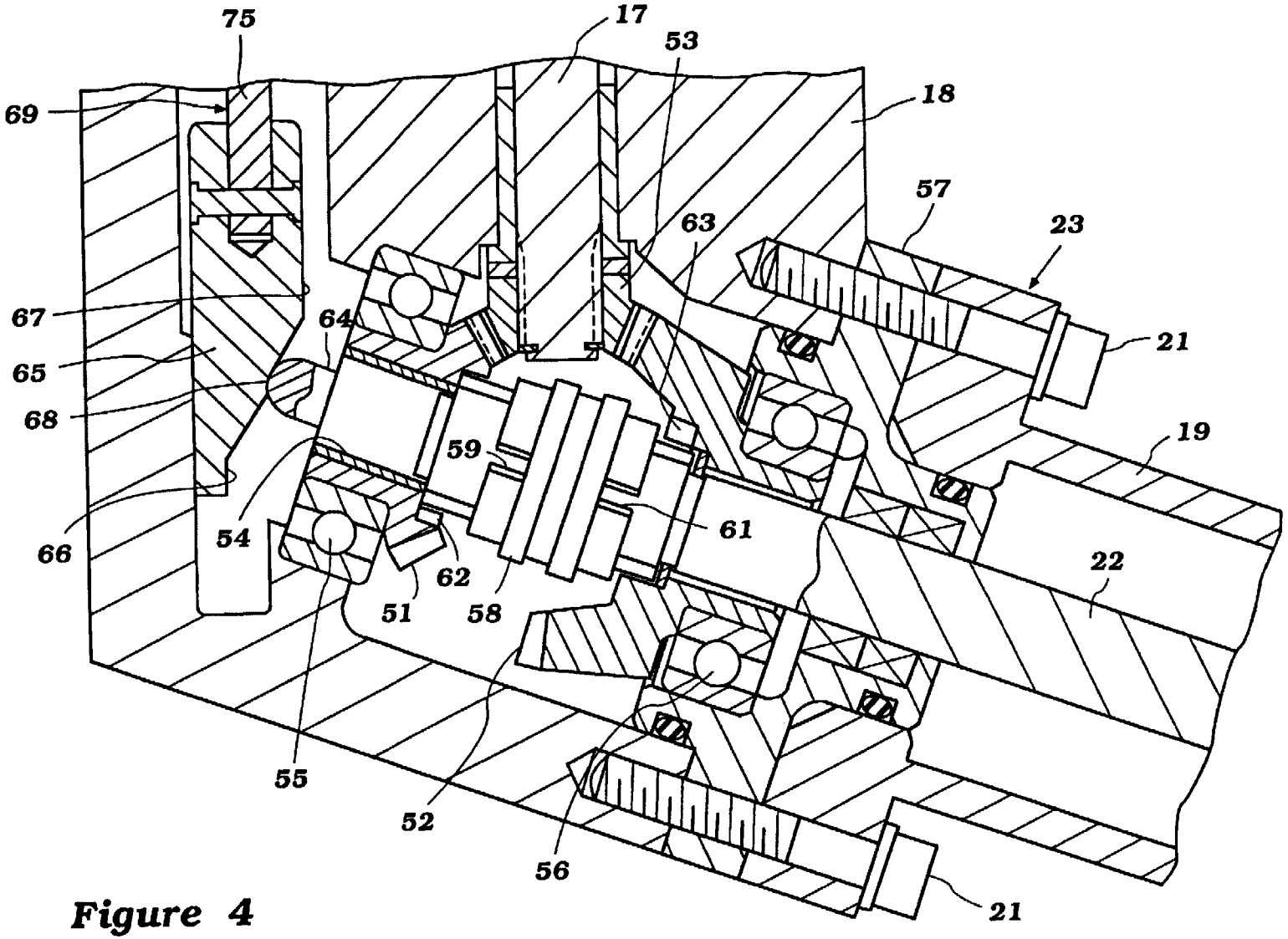
FIG. 4 is a cross-sectional view of the transmission.

The transmission 23 will now be described in detail with reference to FIGS. 2 and 4. The transmission 23 is composed of a first forward driven bevel gear and a second reverse driven bevel gear that are indicated by the reference numerals 51 and 52, respectively, and are axially spaced one from the other. The bevel gears 51 and 52 operatively engage a driving bevel gear 53 that is affixed to the lower end of the first drive shaft 17.

The first bevel gear 51 rotatably journals the upper end of the second drive shaft 22 by means which include a plain type bearing 54. The bevel gear 51 and second drive shaft 22 are rotatably journaled within the first drive shaft housing 18 by means of a ball bearing assembly that is indicated by the reference numeral 55.

The second bevel gear 52 is rotatably journaled by means of a further ball bearing assembly 56 carried by a bearing member 57 that has its outer race affixed along its external periphery to both the first and second drive shaft housings 18 and 19 by means of the bolts 21. The inner race of the ball bearing 56 engages a hub of the bevel gear 52. This hub has a central opening through which the second drive shaft 22 extends. Thus, the first and second bevel gears 51 and 52 are driven about the second drive shaft 22 in opposite directions by the driving bevel gear 53.

A dog clutch is indicated by the reference numeral 58 and is axially slidingly splined to the upper end of the second drive shaft 22 between the forward and reverse bevel gears 51 and 52. The dog clutch 58 has forward and reverse engagement slots 59 and 61 for selectively accommodating forward and reverse teeth that are indicated by the reference numerals 62 and 63 and formed in the forward and reverse bevel gears 51 and 52, respectively.

A push rod 64 is connected by a pin (not shown) to the dog clutch 58. The push rod has an upper end that engages a cam 65 disposed in a cavity of the first drive shaft housing 18. The cam surface of the cam 65 is formed with positions corresponding to forward, neutral and reverse gear, and are indicated by the reference numerals 66, 67 and 68, respectively. The operative position of the cam 65 is controlled by a transmission control that is indicated by the reference numeral 69 and will be described in detail later.

The transmission 23 functions in the following manner. When the forward gear cam surface 66 is positioned by the transmission control 69, such that it engages the upper end of the push rod 64, the dog clutch 58 will be forced by a coil spring (not shown) to a position along the second drive shaft 22 where its forward engagement slot 59 engages the forward tooth portion 62 of the forward beveled gear 51. This effectively couples the dog clutch 58 to the forward bevel gear 51 and, thus, couples the second drive shaft 22 to the first drive shaft 17, thus, causing the propeller 24 to drive the watercraft 25 forwardly.

In like manner, when the reverse gear cam surface 68 is in engagement with the push rod 64, the dog clutch 58 will be positioned such that its reverse engagement slot 61 engages the reverse tooth portion 63 of the reverse bevel gear 52. This couples the dog clutch 58 to the reverse bevel gear 52 and, thus, causes the second drive shaft 22 to drive the propeller 24 in the reverse direction. When the neutral gear cam surface 67 is in engagement with the push rod 64, as is shown in FIG. 4, the dog clutch 58 is positioned such that it is not engaged to either of the bevel gears 51 and 52, and the second drive shaft 22 is, thus, not driven.

The position of the cam 65 is controlled by the transmission control 69 which consists of a handle 71 mounted atop a shift lever 72 that is pivotally connected to the tiller 32. A first link 73 is pivotally connected to the lower end of the shift lever 72 (FIG. 2) and extends rearwardly through an opening formed in the first drive shaft housing 18 to pivotally connect to a connecting bracket 74 which is rotatably journaled within the housing 18. A second link 75 is pivotally connected to the bracket 74 and extends downwardly to connect to the cam 65.

By pushing the shift lever 72 rearward, the first link 73 will cause the connecting bracket 74 to rotate counterclockwise. This causes the second link 75 to pull the cam 65 upwardly such that the cam surface forward portion 68 engages the push rod 64 and forward gear is engaged. In like manner, reverse and neutral settings are engaged by positioning the shift lever 72 forwardly and upright, respectively.

Figure 5:
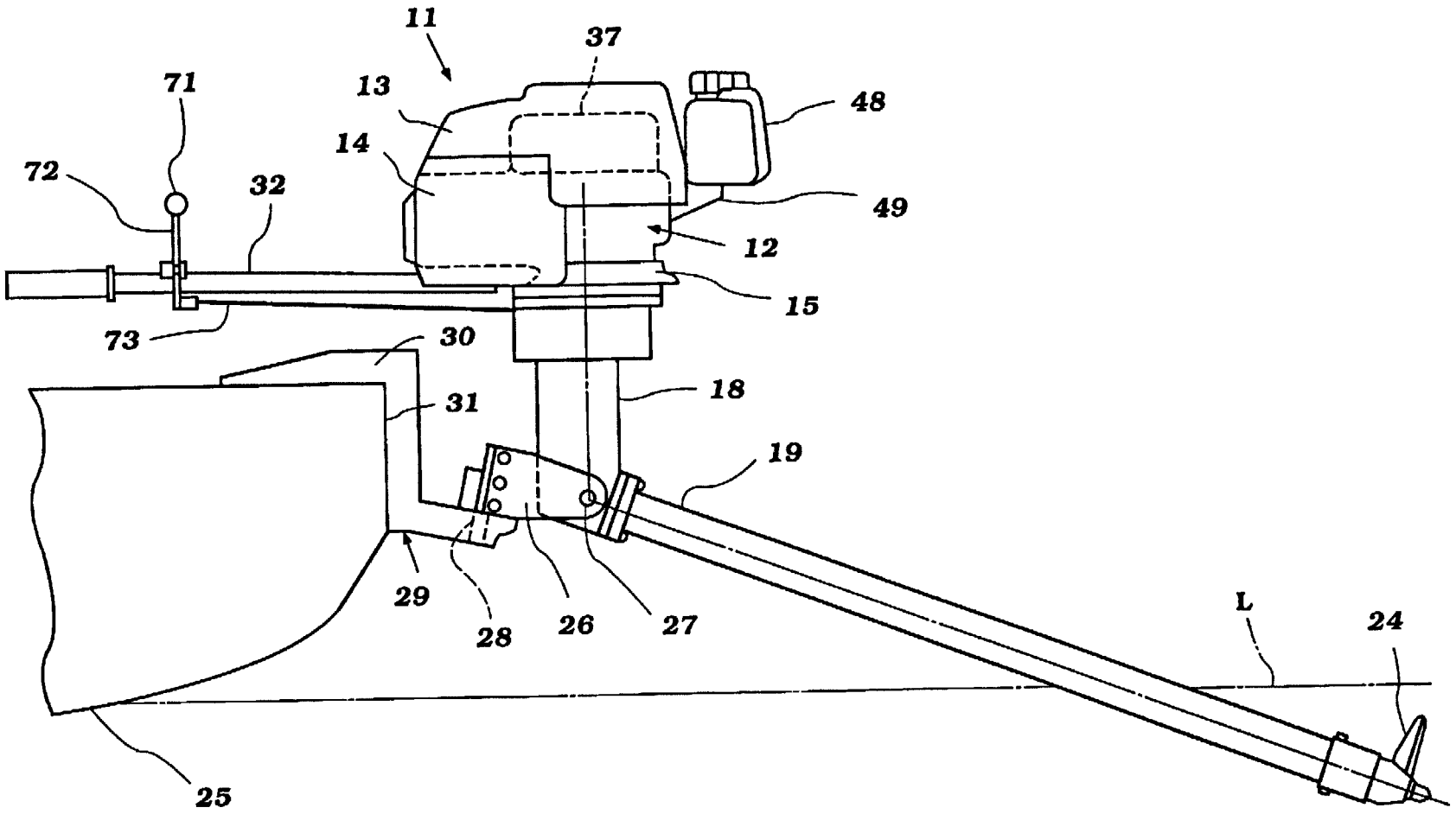
FIG. 5 is a side elevational view of an outboard motor, in part similar to FIG. 1 and showing a second embodiment of the invention.

In FIG. 5, another embodiment of outboard motor generally similar to the configuration illustrated in FIGS. 1–4 is shown. This embodiment varies from the configuration of FIGS. 1–4 in that a different bracket 76 replaces the bracket 26 used to connect the outboard motor 11 to the mounting bracket 29 which has also been modified to extend further rearwardly and further downwardly closer to the water level L. This embodiment places the steering axis ahead of the tilt axis.

Figure 6:
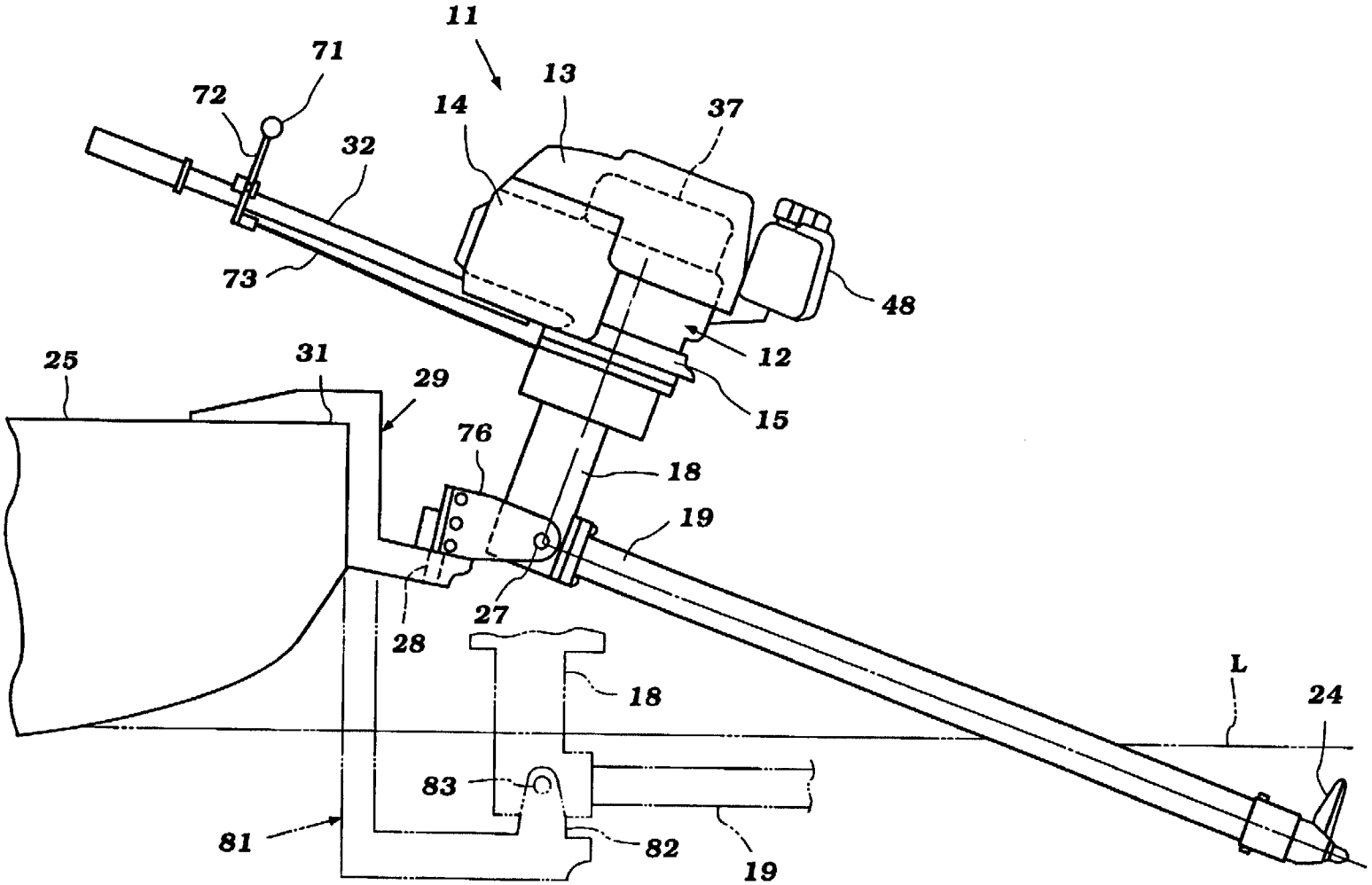
FIG. 6 is a side elevational view of an outboard motor, in part similar to FIGS. 1 and 5, constructed in accordance with another embodiment of the invention.

A further configuration is illustrated in FIG. 6 where the brackets 76 and 29 are retained, but the outboard motor 11 has been modified such that the second drive shaft housing 19 is oriented orthogonal to the axis of the first drive shaft housing 18. This means that the upper portion of the outboard motor 11 must be oriented at some angle from vertical in order to position the propeller 24 below the level of the water L from the driving of the watercraft 25.

All of the above-described outboard motor configurations dispose the steering and trim axes substantially below the upper edge of the transom 31 and close to the water level. FIG. 6 shows in phantom another embodiment of mounting bracket that permits the horizontal tilt axis to be disposed below the water level L.

A mounting bracket constructed in accordance with this embodiment of the invention is indicated by the reference numeral 81 and extends below the water level L. A second bracket 82 is pivotally connected about a vertical axis to the mounting bracket 81 at its rear-most end and rotatably journals the first drive shaft housing 18 of the outboard motor 11 about a horizontal axis by means of a pivot shaft 83.

With the above-described configuration, it is seen that the second drive shaft housing 19 is completely submerged below the water level L and disposed horizontally. This increases the effective propulsive drive force and also allows the propeller 24 to be easily tilted above the water level L in those situations where it is necessary to do so, such as when to avoid any obstacles floating at water level or the like.

From the foregoing, it should be readily apparent that the above-described marine propulsive system allows the easy tilting motion of an outboard motor about a horizontal axis that is disposed close to or below the level of the water in which the watercraft driven by the outboard motor is operating. They also permit the use of powering engines having generally vertically extending output shafts. Of course, the foregoing description is that of preferred embodiments of the invention and it will be readily apparent to those skilled in the art how various changes and modifications may be made from the described embodiments without departing from the spirit and scope of the invention as defined by the appended claims.

What is claimed is:

1. An outboard propulsion system adapted to be affixed at the rear of a watercraft for propelling the watercraft, said propulsion system being comprised of a first assembly consisting of a powering internal combustion engine and a generally vertically extending first drive shaft housing for journaling a first drive shaft driven by said engine and rotating about a generally vertically extending axis, a second drive shaft housing affixed at its forward end to the lower end of said first drive shaft housing and extending generally horizontally rearwardly therefrom, a second drive shaft journaled in said second drive shaft housing, a transmission for driving said second drive shaft from said first drive shaft, a propulsion device driven by the rear end of said second drive shaft, and means for supporting said propulsion system for steering movement about a generally vertically extending axis and for tilt movement about a generally horizontally extending axis disposed transversely to and which does not intersect the steering axis, said steering axis and said tilt axis being spaced longitudinally from each other with said axis being disposed to the rear of said steering axis.

2. An outboard propulsion system as set forth in claim 1, wherein the transmission for driving the second drive shaft from the first drive shaft is disposed at the juncture of the drive shaft housings with each other.

3. An outboard propulsion system as set forth in claim 2, wherein the transmission is a shiftable transmission shiftable between a forward drive position wherein the propulsion device is driven in a first direction and a reverse drive position wherein the propulsion device is driven in a reverse direction.

4. An outboard propulsion system as set forth in claim 3, wherein the transmission comprises a driving bevel gear affixed to the lower end of the first drive shaft, a pair of axially spaced first and second driven bevel gears enmeshed with said driving bevel gear on opposite sides thereof and journaled for rotation relative to the second drive shaft, and means for selectively coupling said first and said second driven bevel gears for simultaneously rotation with said second drive shaft for driving said drive shaft in the selected forward and reverse directions.

5. An outboard propulsion system as set forth in claim 4, further including a control tiller extending forwardly from the upper portion of the first drive shaft housing and carrying a transmission control at the forward end thereof for shifting the transmission between its driving conditions.

6. An outboard propulsion system as set forth in claim 1, wherein the first assembly is mounted on the watercraft so that its steering and tilt axes are close to the water level in which the watercraft is operating.

7. An outboard propulsion system as set forth in claim 6, wherein the transmission for driving the second drive shaft from the first drive shaft is disposed at the juncture of the drive shaft housings with each other.

8. An outboard propulsion system as set forth in claim 7 wherein the engine has an output shaft that rotates about a vertical axis.

9. An outboard propulsion system as set forth in claim 1, wherein the transmission for driving the second drive shaft from the first drive shaft is disposed at the juncture of the drive shaft housings with each other.

10. An outboard propulsion system as set forth in claim 9, wherein the transmission is a shiftable transmission shiftable between a forward drive position wherein the propulsion device is driven in a first direction and a reverse drive position wherein the propulsion device is driven in a reverse direction.

11. An outboard propulsion system as set forth in claim 10, wherein the transmission comprises a driving bevel gear affixed to the lower end of the first drive shaft, a pair of axially spaced first and second driven bevel gears enmeshed with said driving bevel gear on opposite sides thereof and journaled for rotation relative to the second drive shaft, and means for selectively coupling said first and said second driven bevel gears for simultaneously rotation with said second drive shaft for driving said drive shaft in the selected forward and reverse directions.

12. An outboard propulsion system as set forth in claim 11, further including a control tiller extending forwardly from the upper portion of the first drive shaft housing and carrying a transmission control at the forward end thereof for shifting the transmission between its driving conditions.

13. An outboard propulsion system as set forth in claim 12, wherein the steering axis and the tilt axis do not intersect each other.

14. An outboard propulsion system as set forth in claim 13, wherein the steering axis and the tilt axis are spaced longitudinally from each other.

15. An outboard propulsion system as set forth in claim 14, wherein the tilt axis is disposed to the rear of the steering axis.

* * * * *